US011820131B2

(12) United States Patent
Schneider

(10) Patent No.: US 11,820,131 B2
(45) Date of Patent: Nov. 21, 2023

(54) METHOD AND DEVICE FOR DETERMINING FAULTY PRINT NOZZLES OF A PRINTING DEVICE

(71) Applicant: Canon Production Printing Holding B.V., Venlo (NL)

(72) Inventor: Claus Schneider, Eching (DE)

(73) Assignee: Canon Production Printing Holding B.V., Venlo (NL)

( * ) Notice: Subject to any disclaimer, the term of this patent is extended or adjusted under 35 U.S.C. 154(b) by 282 days.

(21) Appl. No.: 17/124,436

(22) Filed: Dec. 16, 2020

(65) Prior Publication Data

US 2021/0178754 A1 Jun. 17, 2021

(30) Foreign Application Priority Data

Dec. 17, 2019 (DE) ..... 102019134721.1

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586
See application file for complete search history.

(56) References Cited

U.S. PATENT DOCUMENTS 8,867,796 B2 * 10/2014 Vans ..... H04N 1/00029 358/1.9
9,302,474 B2 4/2016 Koerner et al.
2010/0238223 A1 9/2010 Yamazaki
2010/0321437 A1 12/2010 Ogama
2012/0250040 A1 10/2012 Yamazaki

FOREIGN PATENT DOCUMENTS

DE 102014106424 A1 11/2015
DE 10 2016 120 753 A1 5/2018

OTHER PUBLICATIONS

German Action dated Jul. 3, 2020, Application No. 10 2019 134 721.1.

* cited by examiner

*Primary Examiner* — Thinh H Nguyen

(74) *Attorney, Agent, or Firm* — THE WEBB LAW FIRM

(57) ABSTRACT

In a method and a device for determining faulty print nozzles of a printing device, a plurality of print nozzles of at least one primary color are activated so that they print dots of a test image onto a recording medium, said dots forming lines as viewed in the printing direction, in a plurality of line rows that are successive as viewed in the printing direction and travel in the line direction. The lines of successive line rows are displaced counter to one another in the line direction, and the lines of each line row have a predetermined constant pitch from one another in the line direction. Furthermore, using an image detector, the printed test image is detected per pixel and image data are provided, wherein an image pattern processing implements a homogenization of the image data via filtering, evaluates the homogenized image data, and determines defective image regions.

15 Claims, 5 Drawing Sheets

METHOD AND DEVICE FOR DETERMINING FAULTY PRINT NOZZLES OF A PRINTING DEVICE

CROSS REFERENCE TO RELATED APPLICATIONS

This patent application claims priority to German Patent Application No. 102019134721.1, filed Dec. 17, 2019, which is incorporated herein by reference in its entirety.

BACKGROUND

Field

The disclosure relates to a method and a device for determining faulty print nozzles of a printing device with the aid of a test image detected by an image detector.

Related Art

Faulty print nozzles of an inkjet printing device reduce the print quality of a printed print image. In particular, the print image may have an optically visible white streak due to a failed print nozzle. An additional object is the determination of faulty print nozzles of a printing device in order to ensure a high print quality.

DE 10 2016 120 753 A1 describes a method for determining the state of at least one print nozzle of an inkjet printing device. In the known method, a test image is printed with the aid of the printing device. The print nozzles are thereby activated so that a predetermined pattern of lines is printed over 2032 μm of total length onto a recording medium in the transport direction, wherein each print nozzle prints precisely one line. The test image is subsequently detected with the aid of an image detector. Starting from a defined print nozzle of one or more print heads, the line associated therewith is determined in order to determine a state of this defined print nozzle. For this, at every position at which a print nozzle was activated to print a line, a greyscale value of this line is determined and compared with a threshold. A malfunction is established depending on the comparison.

However, the problem exists that, due to the length of the predetermined pattern, respectively only print nozzles of a print bar of one primary color on a page may be checked with respect to their state. Given a typical printing device having four primary colors (CMYK), the print nozzles of each primary color may thereby be checked only every four pages. Given occurring print nozzle errors, this leads to a delayed determination of these, and therefore to a reduced print quality and/or to an increased waste. Furthermore, the checking per line, in which each line is checked by means of threshold analysis, is time-consuming and inefficient.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
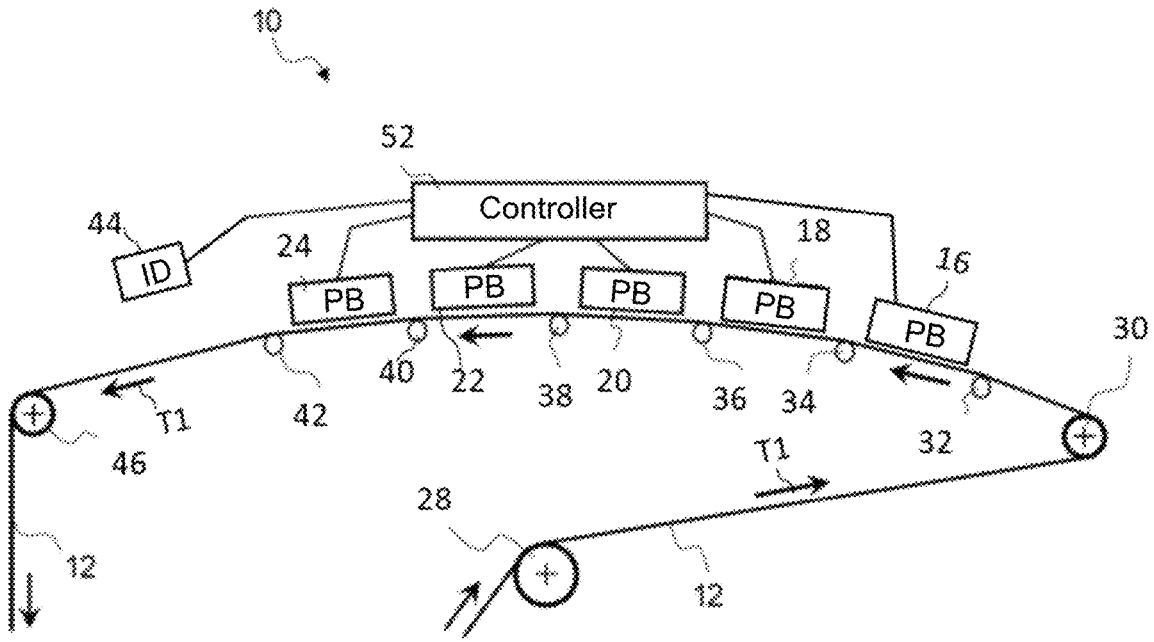
FIG. 1 is a schematic side view of a printing device according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the present disclosure is to reduce the reaction time for determining faulty print nozzles of a printing device. The present disclosure advantageously improves the method known from DE 10 2016 120 753 A1.

According to embodiments of the disclosure, a detection of a print image printed as a defined test image takes place per dot, wherein a plurality of print nozzles of at least one primary color are activated so that they print dots in each print line on a recording medium in a plurality of line rows that are successive as viewed in the printing direction and travel in the line direction, and thus form lines as viewed in the printing direction. Image data are provided in this way, wherein an image pattern processing evaluates homogenized image data and determines defective image regions.

Upon homogenization of the image data, brightness values of the detected image regions are smoothed. This smoothing, or leveling, by means of preferably digital filtering, leads to the situation that missing or faulty lines distinctly stand out from properly printed lines. Such flaws may be quickly and simply detected using homogenized image data. Furthermore, the method allows the detection of the printed test image with lower resolution than the resolution of the printing device in the line direction. At the same time, the method allows the denser arrangement of the printed lines on the recording medium so that the test image on the recording medium is shortened in the printing direction, for example is 800 μm to 1000 μm, in particular 900 μm. In spite of the dense arrangement of the lines and the short length of the test image on the recording medium, with the aid of the homogenization it is possible to print the test image with a resolution of 1200 dpi, for example, and to detect this test image by means of an image detector with a reduced image resolution of 600 dpi, for example, and nevertheless to determine faulty image regions and therefore faulty print nozzles. This reduced space requirement allows all print nozzles of each primary color to be checked with a separate test image on each printed page. This reduces the reaction time in the event of failure of print nozzles, whereby an increase in the print quality is possible with simultaneous reduction of waste.

In particular, the homogenized image data of the detected test image are analyzed, and image regions are detected that have a color property deviating from the average of at least one region of the test image, and the respective associated print nozzles is determined. The homogenization in particular encompasses the smoothing of the image data with the aid of a smoothing mean value algorithm. Print nozzles may thereby be determined that exhibit a malfunction, in particular print nozzles that do not print, or that print incompletely and/or at an angle on the recording medium.

According to a further aspect of the disclosure, a device for generating print images is disclosed that comprises a printing device, an image detector, and a controller. The technical advantages achieved with this device coincide with those that are explained in conjunction with the method according to the disclosure.

FIG. 1 shows a schematic side view of a printing device 10 for printing to a recording medium 12 in the form of a web. In the exemplary embodiment, the printing device 10 is executed as a known inkjet printing device. Such a printing device is known from the document DE 10 2014 106 424 A1, for example.

Figure 2:
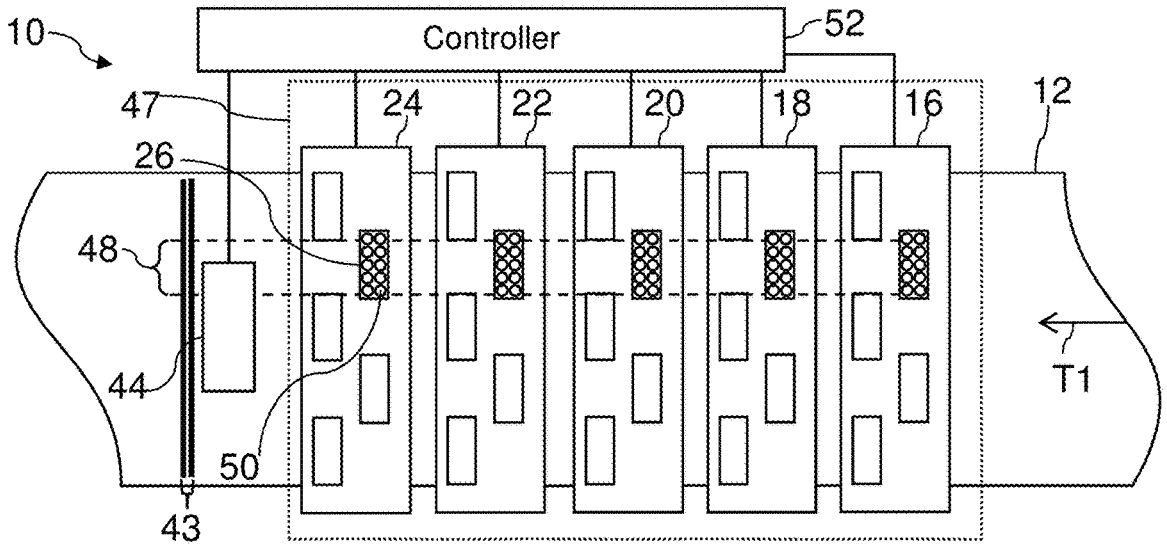
FIG. 2 is a schematic plan view of the printing device according to FIG. 1.

In an exemplary embodiment, the printing device 10 has, per primary color, at least one print bar 18 through 24 having one or more print heads 26, shown in FIG. 2, which are arranged transverse to a transport direction T1 of the continuously drivable recording medium 12 in the form of a web. The transport direction T1 therefore also corresponds to a printing direction T1. The recording medium 12 may be produced from paper, paperboard, cardboard, textile, a combination thereof, and/or other media that are suitable and can be printed to.

As an alternative to continuously supplied recording media 12 in the form of a web, recording media in the form of sheets may also be supplied to the printing device 10 for printing.

The recording medium 12 is directed through the printing device 10 and, via infeed rollers 28, 30 and a plurality of guide rollers 32 through 42, is thereby directed below and past the print bars 16 through 24 having the print heads 26, wherein the print heads 26 apply a print image 43 onto the recording medium 12 in the form of dots. In FIG. 2, the print image 43 is depicted, by way of example, as two bars printed in parallel across the printable width of the recording medium 12.

In an exemplary embodiment, using the image detector 44, the printed print image 43 is detected per line or per region over the entire printable width of the recording medium 12. In an exemplary embodiment, the image detector 44 includes processor circuitry that is configured to perform one or more functions and/or operations of the image detector 44.

With the aid of a takeoff roller 46, the recording medium 12 is further directed to a drying (not shown) and, if applicable, to a subsequent further printing device in which the back side of the recording medium 12 in particular may be printed to. The recording medium 12 may subsequently or alternatively be supplied to a post-processing in which the recording medium 12 is cut, folded, and/or finally processed in other work steps. In particular, test images printed onto the recording medium 12 in the post-processing may be cut out from said recording medium 12.

Four primary colors are typically used for full-color printing, namely CMYK (cyan, magenta, yellow, and black). Additional primary colors, for example green, orange, or purple, may expand the color space of the printing device 10. Moreover, additional colors or special inks such as MICR ink (Magnetic Ink Character Recognition=magnetically readable ink) may also be present. Each primary color is printed onto the recording medium 12 with the print heads 26 of a respective print bar 18 through 24. It is likewise possible that transparent special fluids, such as primer or drying promoter, are likewise digitally applied with the aid of a separate print bar before or after the printing of the print image 43 in order to improve the print quality or the adhesion of the ink to the recording medium 12. In the exemplary embodiment according to FIG. 1, a primer fluid is printed onto the recording medium 12 with the aid of the print bar 16.

FIG. 2 shows a schematic plan view of the printing device 10 according to FIG. 1. The print bars 16 through 24 form a print unit 47. Printing with the full line width is possible with each of the print bars 16 through 24 of the printing device 10. For this, each print bar 16 through 24 comprises a plurality of print heads 26 that are arranged side by side, with gaps, in two rows.

In FIG. 2, each print bar 16 through 24 comprises five print heads 26 in order to apply the print image 43 onto the recording medium 12 in a plurality of columns 48. Each print head 26 comprises a plurality of print nozzles 50 (for simplification, only ten print nozzles are shown in FIG. 2), wherein each print nozzle may apply ink droplets of a variable volume onto the recording medium 12 in the form of dots. In practice, each print head 26 may comprise multiple hundreds to multiple thousands of print nozzles 50 directed toward the recording medium 12. The print nozzles 50 are arranged in a row transverse to the printing direction T1. With the aid of the print nozzles 50 of a print head 26, a print image 43 may be printed over a portion of a line along the printable width of the recording medium 12, and in the form of a column 48 along over the length of the recording medium 12 in the printing direction T1. A region of the recording medium 12 below the print head 26 is thereby printed to by each print head 26.

The printing onto the recording medium 12 takes place according to a two-dimensional raster matrix in which a print nozzle is associated with each raster point of a line of the raster matrix. A raster point that has been printed to, meaning a dot, along a line across the printable width of the recording medium 12 thus has associated therewith a print nozzle 50 of the print bar 18 through 24. The print resolution in the line direction x (meaning transverse to the transport direction T1) is indicated in dpi (dots per inch). It is typically in a range from 600 dpi to 1200 dpi. A corresponding print nozzle is associated with each raster point in the line direction x. Given single-line print heads, the print resolution in the transport direction T1 is determined by the transport velocity of the recording medium 12 and the line timing of the print heads 26 of the print bars 18 through 24 given line-clocked printing.

In an exemplary embodiment, using a controller 52, the individual print nozzles 50 of the print heads 26 of the print bars 18 through 24 are activated, based on print data according to a print raster of raster points, so that the individual ink droplets are applied onto the recording medium 12 at the position in the x-direction and y-direction as defined by the print data, meaning corresponding to the line direction and printing direction T1. The ink droplets on the recording medium 12 form the dots that, in their entirety, form the print image 43 on the recording medium 12. Ink droplets do not need to be applied at each raster point in order to form the print image on the recording medium 12. As noted, the dots and their position as defined by the print data are arranged in a uniform raster across the printable width of the recording medium 12 and in the printing direction T1. It may occur that, due to faulty print nozzles, ink droplets are not printed or ink droplets do not form the provided dot. In an exemplary embodiment, the controller 52 includes processor circuitry that is configured to perform one or more functions and/or operations of the controller 52.

Figure 3:
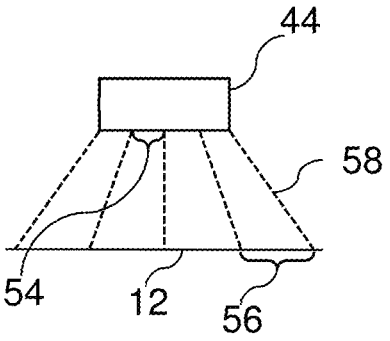
FIG. 3 is a schematic side view of an image detector and of a recording medium for detecting print images printed onto the recording medium according to an exemplary embodiment.

FIG. 3 shows a schematic side view of the image detector 44 and of the recording medium 12 for detecting print images 43 printed onto the recording medium 12. The image detector 44 has a plurality of light-sensitive dot detection regions 54 arranged in at least one line. The dot detection regions 54 respectively comprise sensor elements for detecting the brightness of the incident light in the colors red, green, and blue (RGB). A separate color channel of the image detector 44 is thereby associated with each color (RGB). An image region 56 having one or more raster points and/or dots of the print image 43 printed on the recording medium 12 is detected with the aid of a dot detection region 54.

For each image region 56, the image detector 44 thus detects an optical image of the dots at a light-sensitive dot detection region 54. Each dot detection region 54 thereby has a field of view 58 directed toward the recording medium 12. With the aid of a plurality of dot detection regions 54 arranged side by side in at least one line, the print image 43 is detected over the entire printable width of the recording medium 12. In FIG. 3, only four dot detection regions 54 are shown for simpler presentation.

Typically, depending on the number of dot detection regions 54 of the image detector 44, a plurality of raster points that contain dots and unprinted raster points of the print image 43 are contained in an image region 56. Based on the area coverage of the dots in an image region 56, a brightness value in the color channels RGB of the image detector 44 may be determined for the respective image region 56 of the print image 43 with the aid of the image detector 44.

In an exemplary embodiment, the image detector 44 is executed as a line camera, for example an allPixa Pro camera from the vendor Chromasens that detects the print image 43 line by line. The line camera detects a line of the print image 43 with a plurality of light-sensitive dot detection regions 54 arranged side by side, in particular in the form of a CCD, CMOS, NMOS, or InGaAs sensor. The allPixa Pro line camera has three lines with respectively 4096 dot detection regions 54, for example.

Dot detection regions 54 are also referred to as pixels. Brightness values in a respective color channel of the image detector 44 are detected by each dot detection region 54.

Moreover, in an exemplary embodiment, the controller 52 is configured to compare the image data of the print images 43 with the print data, where the image data being detected in the form of image regions 56 with the aid of the image detector 44, and produce an association of image regions 56 with raster points and/or with dots. With the aid of the association of image regions with raster points and/or dots, the controller also establishes an association with print nozzles. Furthermore, the controller 52 is designed and configured so that the values, for example brightness values, contrast values, and reference values, may be processed and stored for the image detector 44 and an image pattern processing. With the aid of the image pattern processing, the controller 52 is thereby capable of determining defective and/or faulty print nozzles 50, as is described further below using FIG. 7.

Figure 4A:
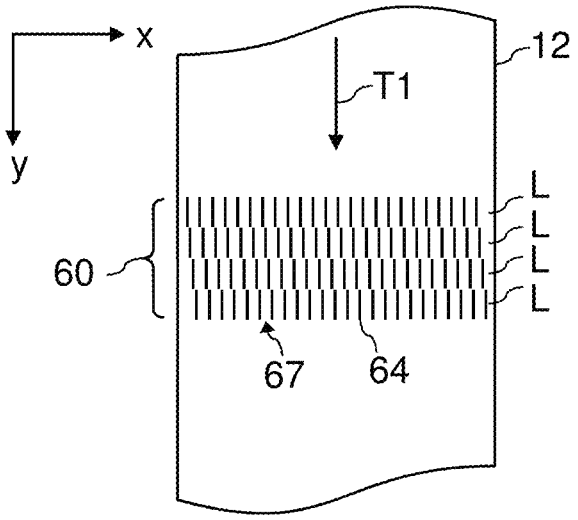
FIG. 4A shows a recording medium with the printed test image according to an exemplary embodiment.
Figure 4B:
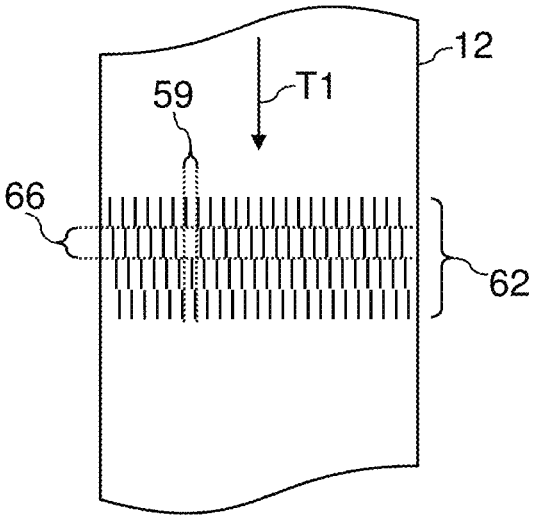
FIG. 4B shows a recording medium with an incorrectly printed test image according to an exemplary embodiment.
Figure 5:
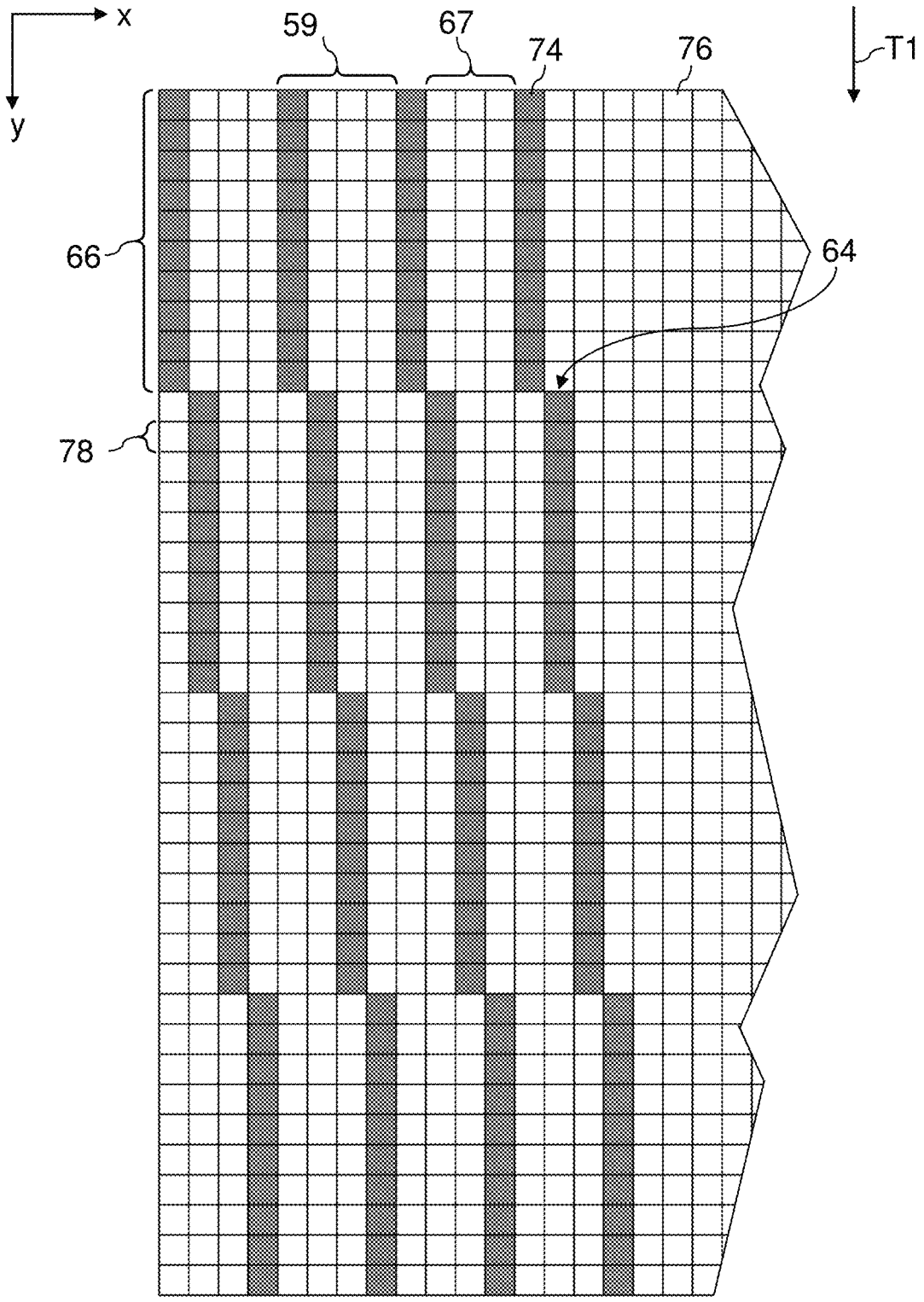
FIG. 5 is a schematic detail view of a test image according to an exemplary embodiment.

FIGS. 4 and 5 show an exemplary embodiment of the method according to the present disclosure. For simplification reasons, the printing device 10 here comprises only 96 print nozzles 50. A generalization for a greater number of print nozzles (up to multiple thousands) takes place further below. These 96 print nozzles 50 print the print image 43 in the form of a test image 60, 62 for a defined primary color. The test image 60, 62 comprises four successive line rows L, wherein, in each line row L (see also reference character 66 in FIG. 5), associated print nozzles 50 print a count of 96/4=24 lines 64 at corresponding raster points 76 in the printing direction y. For example, each line 64 comprises ten printed raster points, meaning ten dots 74. As viewed in the line direction x, the raster points in each line row L are subdivided into groups 59 of four raster points each per print line 78, meaning that each line row L comprises 96/4=24 groups 59. In the first line row L, print nozzles 50 print at first raster points associated therewith of each group 59. The other raster points of each group 59, meaning the second, third, and fourth raster point, are not printed to. Lines 64 traveling in the printing direction y across multiple print lines 78 are thus created in the first line row L.

The second line row L proceeds similarly to the first line row L, but here print nozzles 50 are activated that are respectively associated with the second raster point of each group 59. The other raster points of the respective group 59 are not printed to. The method proceeds analogously in the third and fourth line rows L.

As is apparent, a test image 60 results in which the lines 64 of each line row L have a constant pitch [spacing] of four raster points from one another in the line direction x. The lines 64 of successive lines rows L are respectively displaced counter to one another by one raster point. If the four line rows L were to be printed atop one another, all raster points would thus be printed to in the x-direction by the print nozzles 50. In the present method example, the test image 60, 62 would thus have expanded in the y-direction.

The described example with only 96 print nozzles 50 can be generalized. Given a total count j of print nozzles 50 corresponding to a count j of raster points in the x-direction, the print nozzles i is associated with a defined raster point i, with i as a whole-number control variable i of 1, 2, 3, . . . , j. The i print nozzles or i raster points are organized in the line direction x into n successive groups, wherein k print nozzles or k raster points are associated with each group k, wherein n is a control variable of 1, 2, 3, . . . , o, with o equal to the total number of groups, equal to j/k.

In an exemplary aspect, k successive line rows L are printed, wherein in the k-th line row the k-th print nozzles of each n-th group are activated in order to print lines of the test image. In the example according to FIGS. 4A-4B, j=96, k=4, o=96/4=24.

In practice, for example for a print width of 600 mm and a print resolution of 1200 dpi, j=27000, k=4, o=27000/4=6750. The value k may be varied from 4 to 16. The dots per line 64 may be varied in a range from 6 to 12 and is preferably 10, meaning that each line 64 is printed across ten print lines 78. If ten dots in four line rows L are printed per line 64, the test image 60, 62 is in total 0.8 to 0.9 mm long in the printing direction T1. The test image printed with a print resolution of 1200 dpi is detected by an image detector at a resolution of 600 dpi, and the faulty print nozzles may be determined from the image data of the detected test image.

FIGS. 4A-4B show the test image 60, 62, respectively, printed with the aid of the printing device 10. In FIG. 4A, an error-free printed test image 60 is depicted; by contrast, FIG. 4B depicts an incorrectly printed test image 62. The test image 60 is printed by the print nozzles 50 of a single primary color of the printing device 10; preferably, four test images 60, 62 are printed in succession in a respective single primary color of cyan, magenta, yellow, or black. The pattern is comprised of individual lines 64 printed by a respective print nozzle 50, which lines 64 are arranged at a predetermined, uniform pitch 67 relative to one another in a plurality of line rows L across the printable width of the recording medium 12. The pitch 67 of the lines 64 is thereby chosen so that the image detector 44 respectively detects a line 64 or a portion of a line 64 in each image region 56 upon detection of the test image. The pattern of the test image 60 in the exemplary embodiment results from the method described further below in FIG. 7.

Given error-free printing of the test image 60, a uniform pattern of the test image 60 is printed as depicted in FIG. 4A. In this instance, all print nozzles 60 print without error. In the event that a print nozzle 50 is faulty and does not print, or prints incompletely and/or at an angle on the recording medium 12, the uniform pattern of the test image 60 is interrupted or disturbed and the respective deviation is apparent. These deviations are in particular optically apparent as light regions on the recording medium 12. In FIG. 4B, the test image 62 is depicted with a single faulty print nozzle 50 that is not printing; in this instance, a printed line 64 is missing in the pattern of the test image 62. This may be associated with a defined group 59 and a defined line row 66. A unique association of image regions 56 to individual raster points, and therefore print nozzles 50, is possible due to the pitch between the lines 64.

FIG. 5 shows a schematic detail depiction of a portion of the printed test image 60 of four line rows 66 (corresponding to reference character L in FIG. 4A) and four groups 59. In FIG. 5, the individual dots 74 (colored grey) and raster points 76 (white) that yield the test image 60 are arranged in the raster matrix so as to be demarcated from one another and apparent. In most use cases, the recording medium 12 is white paper, so that unprinted raster points appear lighter than printed dots. Each line 64 in FIG. 5 is printed across ten print lines 78 and thus comprises ten dots 74 in the printing direction T1. The pitch 67 between two lines 64 of a line row 66 encompasses three raster points 76 transverse to the printing direction T1 in a print line 78. Furthermore, the lines 64 of a line row 66 are arranged offset, respectively by a raster point 76, from the lines 64 of the following line row 66.

Figure 6A:
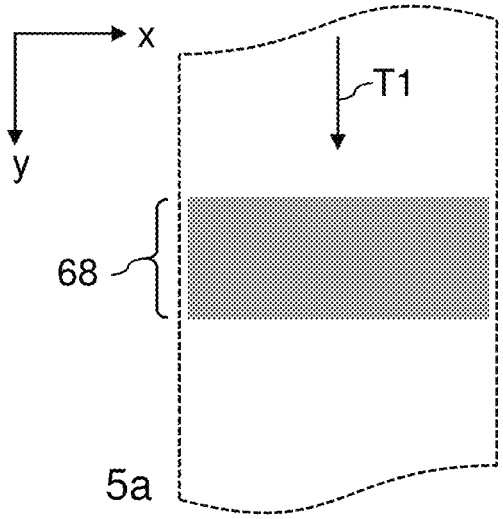
FIG. 6A shows a detected test image according to an exemplary embodiment.
Figure 6B:
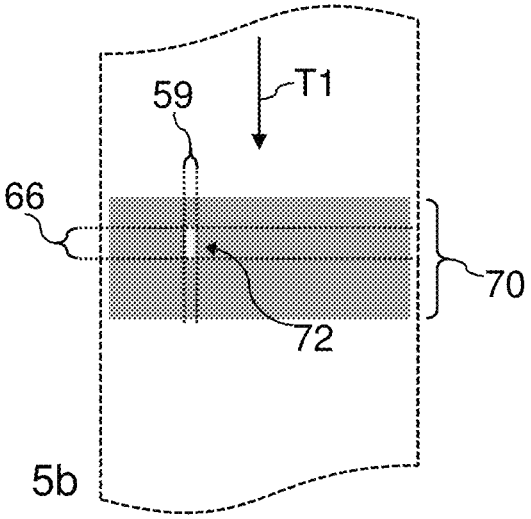
FIG. 6B shows a detected test image having an incorrect region according to an exemplary embodiment.

FIGS. 6A-6B show schematic depictions of the test image 60, 62 according to FIGS. 4A-4B, detected with the aid of the image detection device 44, after it has been homogenized with the aid of the image pattern processing. The outline of the recording medium 12 is depicted in dashed lines in FIGS. 6A-6B for better comprehension; the homogenized test image 68, 70 is not located on the recording medium 12, but rather is stored and processed in the form of image data with the aid of the image pattern processing. An error-free test image 68 is depicted in FIG. 6A; a test image 70 having an incorrect region 72 is depicted in FIG. 6B. Given homogenization, a color property of the image regions 56 of the test image 60, 62 is smoothed and/or filtered digitally over the regions of the test image 60, 62. This homogenization corresponds to a low-pass filtering of an image signal, wherein high frequencies are filtered out and thus a softening of the test image 60, 62 takes place. In particular, a brightness value of the image regions 56 is used as a color property.

Given a test image 60 printed without error, an area with nearly uniform brightness as depicted in the homogenized test image 62 in FIG. 6A results from the homogenization. Given an incorrectly printed test image 62, for example due to a non-printing print nozzle 50, the incorrect region 72 is apparent as a light region 72 in the homogenized test image 70, as depicted in FIG. 6B. For example, due to the homogenization it is easily possible for an operator to achieve a good overview of the quality of the test image 60, 62 at a glance.

The homogenization is determined as a sliding mean value in the exemplary embodiment. The arithmetic mean of the brightness value of the image region 56 is thereby respectively calculated iteratively over a fixed number of image regions 56 lying next to one another in the line direction.

The sliding mean value is the series of mean values of the brightness values of a successive image regions 56. In the practical example, "a" is equal to five. The arithmetic average of the brightness values is thereby respectively determined iteratively for five successive image regions 56 in the line direction. As a result, a new image data set is determined that forms the homogenized test image 70, 72.

Alternatively, the homogenization is implemented by means of a weighted sliding mean value algorithm or an exponential sliding mean value algorithm. For this purpose, linear or exponential weightings are associated with the brightness values before the mean value calculation.

Starting from the homogenized test image 70, 72, the determination of the faulty print nozzles 50 then takes place in the image pattern processing.

Figure 7:
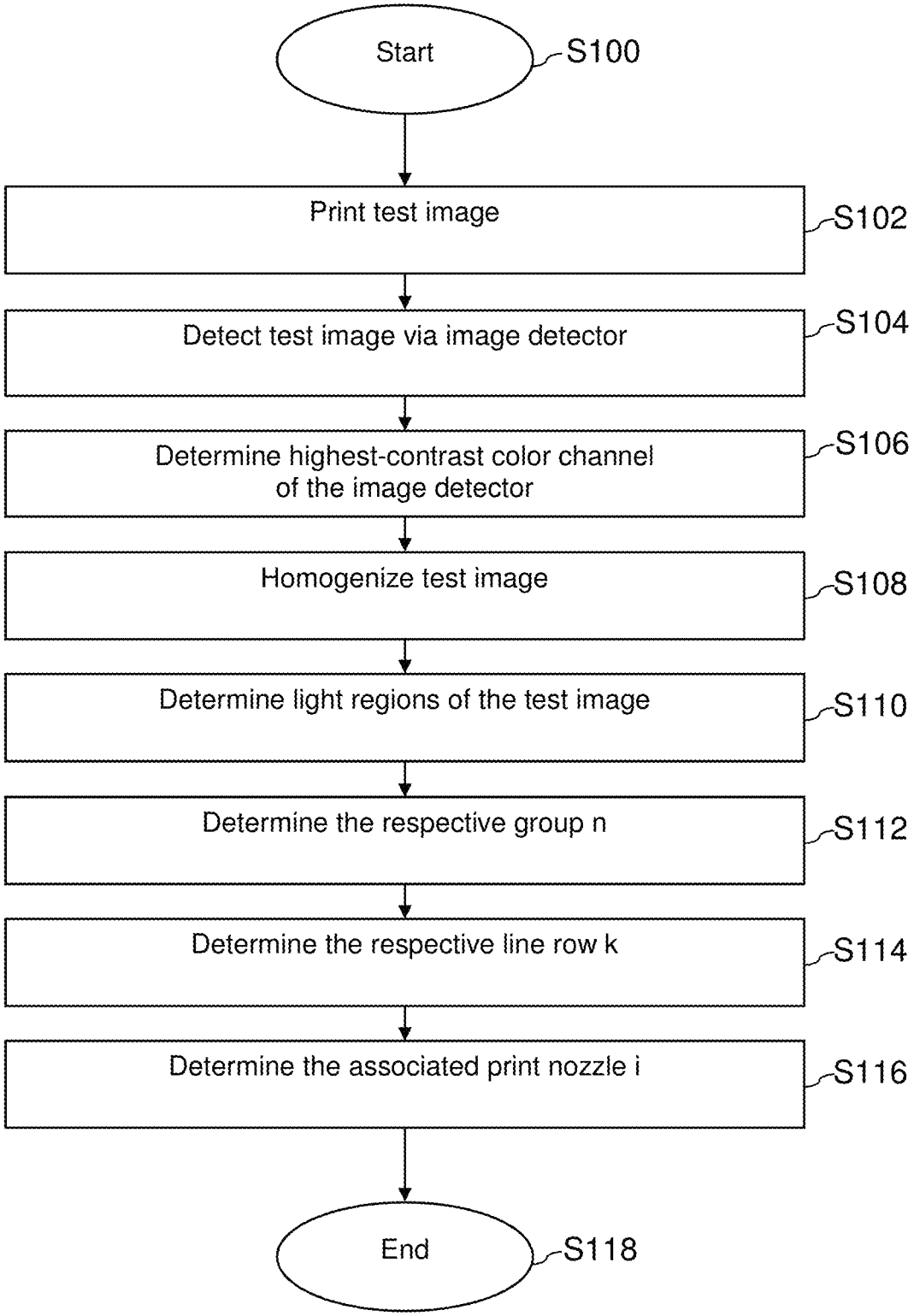
FIG. 7 is a flowchart of a method for determining faulty print nozzles of a printing device according to an exemplary embodiment.

FIG. 7 shows a flowchart of the method for determining faulty print nozzles of a primary color of the printing device 10. The workflow starts in step S100.

The test image 60, 62 is printed in step S102. In the exemplary embodiment according to FIGS. 4A-4B, 96 print nozzles are activated for this so that, at first, the first print nozzles 50 of each group n respectively print the line 64 of the test image 60, 62 in a first line row L, then the second print nozzles 50 of each group n respectively print the line 64 of the test image 60, 62 in a second line row L, the third print nozzles 50 of each group n subsequently, respectively print the line 64 of the test image 60, 62 in a third line row L, and lastly the fourth print nozzles 50 of each group n respectively print the line 64 of the test image 60, 62 in a fourth line row L. The resulting test image 60, 62 is depicted in FIGS. 4A-4B. In the exemplary embodiment, the test image 60, 62 is printed on the recording medium 12 in the primary color of black. Alternatively, the test image 60, 62 is printed multiple times in a respective primary color of the printing device 10.

In step S104, the test image 60, 62 printed in step S102 is detected per dot with the aid of the image detector 44.

In the next step S106, the image pattern processing determines, with the aid of the detected test image 60, 62, the color channel of the image detector 44 in which the detected test image 60, 62 has the highest contrast. In the further course of the method, the image data of the determined color channel are used in order to analyze the detected test image 60, 62. These image data are brightness values of a color channel of the image detector 44.

In step S108, the image data of the test image 60, 62 are homogenized by the image pattern processing with the aid of a previously described sliding mean value algorithm.

In step S110, regions 72 in the homogenized test image 68, 70 are determined that are lighter than a preset reference value stored in the controller 52. A reference value is stored in the controller 52 for each primary color of the printing device 10. This reference value is also referred to as a threshold. Brightness values of a color channel of the image detector 44 typically range from 0 to 255. In most use cases, the recording medium 12 is white paper. The threshold may then be established between 120 and 150, for example. A region 72 that exceeds the threshold indicates an incorrect and/or unprinted line 64, and thus a faulty print nozzle.

In a further embodiment of the method, in step S110, a reference value is determined depending on the average brightness of all image regions of the homogenized test image 68, 70.

Based on the print data of the test image 68, 70, in step S112 the associated n-th group 59 in which the region 72 is located is associated with said determined region 72.

In step S114, the k-th line row 66 in which the region 72 is located is associated for each region 72 determined in step S110.

In step S116, the associated print nozzle i is subsequently determined for the region 72 determined in step S110, based on the n-th group determined in step S112 and on the k-th line row determined in step S114. The faulty print nozzle is thus uniquely identified. If a plurality of conspicuous regions 72 are present in the homogenized image data of the test image, the associated print nozzle i is thus determined for each region 72. The workflow ends in step S118.

The described method is characterized by technologically high efficiency and economy. With the aid of the homogenization of the image data, an analysis of the image data prepared in this way may take place with high speed, and incorrect image regions may be detected and the associated faulty print nozzles may be identified. The digital algorithm or the digital filter that is to be used for homogenization are of simple design and operate at high speed. The resolution in dpi for the image detector 44 may be markedly reduced with respect to the print resolution in the line direction, which enables cost-effective camera systems to be used.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 printing device
12 recording medium
16 to 24 print bars
26 print head
28, 30 take-off roller
32 to 42 guide roller
43 print image
44 image detector
46 take-up roller
47 printing unit
48 columns of the print image on recording medium
50 print nozzle
52 controller
54 dot detection region
56 image region
58 field of view of the dot detection regions
59 groups
60 test image
62 incorrect test image
64 line of the test image
66, L line row
67 pitch between two lines 64
68 homogenized test image
70 incorrect homogenized test image
72 incorrect region
74 dot
76 raster point
78 print line
T1 printing direction, transport direction

The invention claimed is:

1. A method for determining faulty print nozzles of a printing device, the method comprising:

activating a plurality of print nozzles of at least one primary color to print dots of a test image, the dots forming lines as viewed in a printing direction, in each print line onto a recording medium in a plurality of line rows that are successive as viewed in the printing direction and travel in a line direction, the plurality of line rows respectively including a predetermined number of print lines;

displacing the formed lines of successive line rows of the plurality of line rows counter to one another in the line direction, wherein the formed lines of each line row of the plurality of line rows have a predetermined constant pitch from one another in the line direction; and detecting, using an image detector, the printed test image per pixel and providing image data, wherein an image pattern processing: implements a homogenization of the image data via filtering, evaluates the homogenized image data, and determines defective image regions, wherein:

the test image is printed in a predetermined raster onto the recording medium with using i print nozzles, i being a whole-number control variable that ranges from 1 to j, where j is a set of all print nozzles of the primary color, a raster point on the recording medium in the line direction is associated with each print nozzle i, the i print nozzles, as viewed in the line direction, are organized into n successive groups per k successive print nozzles, k being a number of print nozzles in each of the successive groups, and n being a control variable ranging from 1 to o, o being a count of all of the groups that results from j/k, the k-th print nozzle of each n-th group are activated to print the respective line of the test image in a k-th line row.

2. The method according to claim 1, wherein the image pattern processing:

analyzes the homogenized image data of the detected test image and detects image regions that have a color property deviating from an average of at least one region of the test image, respectively determines the associated k-th line row and the respective associated n-th group, and determines the respective associated i-th print nozzle based on the determined associated k-th line row and the respective associated n-th group.

3. The method according to claim 2, wherein the color property is a brightness value.

4. The method according to claim 1, wherein the image pattern processing to homogenize the image data includes, as an algorithm, a sliding mean calculation of adjacent image region.

5. The method according to claim 1, wherein the image pattern processing: compares the homogenized image data with a threshold, and signals an error depending on the comparison.

6. The method according to claim 1, wherein the number m of dots of the lines printed in the printing direction in each line row is two to twelve.

7. The method according to claim 1, wherein the number m of dots of the lines printed in the printing direction in each line row is eight to ten.

8. The method according to claim 1, the number k of print nozzles in each group is three to six.

9. The method according to claim 1, the number k of print nozzles in each group is four.

10. The method according to claim 1, wherein the test image is printed in a respective primary color with the aid of the print nozzles.

11. The method according to claim 1, wherein four test images are printed successively in a respective single primary color with the aid of the print nozzles.

12. The method according claim 1, the image pattern processing for the analysis of the detected test image selects a color channel of the image detector in which the detected test image has a highest contrast.

13. The method according to claim 1, wherein a resolution of the image detector is less than or equal to half of a resolution with which the printing device prints test images in the line direction.

14. A non-transitory computer-readable storage medium with an executable program stored thereon, that when executed, instructs a processor to perform the method of claim 1.

15. A device for generating print images, comprising:

a printer configured to generate at least one test image on a recording medium, the printer including print nozzles;

an image detector arranged downstream of the printer in a printing direction and configured to detect the test image generated on the recording medium; and a controller configured to:

activate a plurality of the print nozzles of at least one primary color so that the plurality of print nozzles print dots of a test image in each print line onto the recording medium in a plurality of line rows that are successive as viewed in the printing direction and travel in a line direction, the plurality of line rows respectively including a predetermined number of print lines, wherein the dots form lines as viewed in the printing direction;

displace the lines of successive line rows counter to one another in the line direction, wherein:

the lines of each line row have a predetermined constant pitch from one another in the line direction, the image detector detecting the printed test image per dot to provide image data, and the controller is further configured to, using an image pattern processing, implement a homogenization of the image data via filtering, evaluate the homogenized image data, and determine defective image regions, wherein:

the test image is printed in a predetermined raster onto the recording medium with using i print nozzles, i being a whole-number control variable that ranges from 1 to j, where j is a set of all print nozzles of the primary color, a raster point on the recording medium in the line direction is associated with each print nozzle i, the i print nozzles, as viewed in the line direction, are organized into n successive groups per k successive print nozzles, k being a number of print nozzles in each of the successive groups, and n being a control variable ranging from 1 to o, o being a count of all of the groups that results from j/k, the k-th print nozzle of each n-th group are activated to print the respective line of the test image in a k-th line row.

* * * * *